US007690935B2

(12) United States Patent
Laitinen

(10) Patent No.: US 7,690,935 B2
(45) Date of Patent: Apr. 6, 2010

(54) CONNECTOR STRUCTURE

(75) Inventor: Timo Laitinen, Viiala (FI)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 12/002,328

(22) Filed: Dec. 14, 2007

(65) Prior Publication Data

US 2009/0156038 A1 Jun. 18, 2009

(51) Int. Cl.
*H01R 13/62* (2006.01)

(52) U.S. Cl. ..... 439/260

(58) Field of Classification Search ..... 439/260, 439/267, 140–141, 152–160, 489
See application file for complete search history.

(56) References Cited

U.S. PATENT DOCUMENTS 5,492,480 A * 2/1996 Fusselman et al. ..... 439/157
6,089,895 A * 7/2000 Hashiguchi et al. ..... 439/260
6,358,082 B1 3/2002 Letourneau
6,557,761 B1 * 5/2003 Oya et al. ..... 235/441

FOREIGN PATENT DOCUMENTS

WO WO 2005/104007 11/2005

* cited by examiner

*Primary Examiner*—Jean F Duverne
(74) *Attorney, Agent, or Firm*—Alfred A. Fressola; Ware, Fressola, Van Der Sluys & Adolphson, LLP

(57) ABSTRACT

The invention relates to a connector comprising at least a contact element, which has at least an unconnected state and a connected state; and a pre-loading element, which has at least a first position and a second position. When the pre-loading element is in the first position, it forces the contact element into the unconnected state and when the pre-loading element is in the second position, it allows the contact element to transfer to the connected state.

18 Claims, 5 Drawing Sheets

CONNECTOR STRUCTURE

FIELD OF THE INVENTION

The present invention relates to a connector structure and a device with a connector, such as a mobile phone, a personal computer, a hand-held computer, a hand-held media device, or a game machine

BACKGROUND OF THE INVENTION

An integrated circuit (IC) card electronic apparatus is a type of equipment in which information is electrically transferred between circuitry on the electronic apparatus and an IC circuit in a card with desired functions or programs, which card is inserted into a card receptacle slot of the apparatus. The apparatus is common in mobile phones, personal computers, hand-held computers, hand-held media devices, game machines and other electronic equipment.

An IC card consists of a compact, thin, inflexible card body, typically about 0.8-2.0 mm thick. An IC chip (integrated circuit device) having the desired functions is built into such a rigid or semi-rigid card body made of plastic or reinforced cardboard, and numerous contacts (i.e. connecting terminals) are arranged along an edge on the surface of the card.

An IC card may be inserted into the card receiving slot on the electronic equipment, with the card edge having the contacts oriented toward the card receiving slot and with the card face, on which the contacts are arranged, oriented toward the operator, until the card edge abuts the bottom of the connector slot. Thus, the contacts come into full contact with the corresponding contact springs of the slot, so that the IC circuit on the card is electrically interconnected to the control circuit on the electronic equipment to allow information to be transferred between them. Contact springs in card readers have a shape where the end of the spring is bent first up, then down. Therefore, the connector structure is much thicker than the card.

SUMMARY OF THE INVENTION

It is, therefore, an object of the present invention to provide a new connector structure that makes thinner connectors possible.

It is another object of the present invention to provide a device with a connector structure.

The foregoing objects are accomplished by a connector comprising at least a contact element, which has at least an unconnected state and a connected state; and a pre-loading element, which has at least a first position and a second position. When the pre-loading element is in the first position it forces the contact element into the unconnected state and when the pre-loading element is in the second position it allows the contact element to move into the connected state.

In one embodiment the connector comprises several contact elements and one pre-loading element is adapted to affect these several elements.

In one embodiment the connector comprises a spring-like contact element and a tip of the contact spring is adapted to form a contact when in the connected state.

In one embodiment the connector is a memory card connector and the contact element is adapted to contact a contact of the memory card. In one embodiment the connector further comprises several contact elements and one pre-loading element is adapted to affect these several elements. The connector structure can be used in many other applications as well, for example, subscriber identity module (SIM) connectors, universal serial bus (USB) connectors, bottom connectors, battery connectors, charger connectors and many other types of connectors.

In one embodiment the connector comprises a first group of contact elements and a second group of contact elements and the first group of contact elements is adapted to contact the first side of the memory card and the second group of contact elements is adapted to contact the second side of the memory card. In one embodiment one pre-loading element is adapted to affect the first group of contact elements and the second group of contact elements.

In one solution the contact elements are not electrically attached to the printed wiring board (PWB), but instead, when a card is inserted into the card reader, the card presses the contact elements so that the contact elements come into contact with the PWB, which has contact areas for connection.

As the size of mobile devices is very relevant for the markets, this invention improves current solutions because the thickness of the reader can be reduced somewhat as the invented solution does not require as much height as previous current solutions.

DESCRIPTION OF THE DRAWINGS

The objects and features of the present invention will become more apparent from the consideration of the following detailed description taken in conjunction with the accompanying drawings, in which.

DETAILED DESCRIPTION OF THE INVENTION

Figure 1:
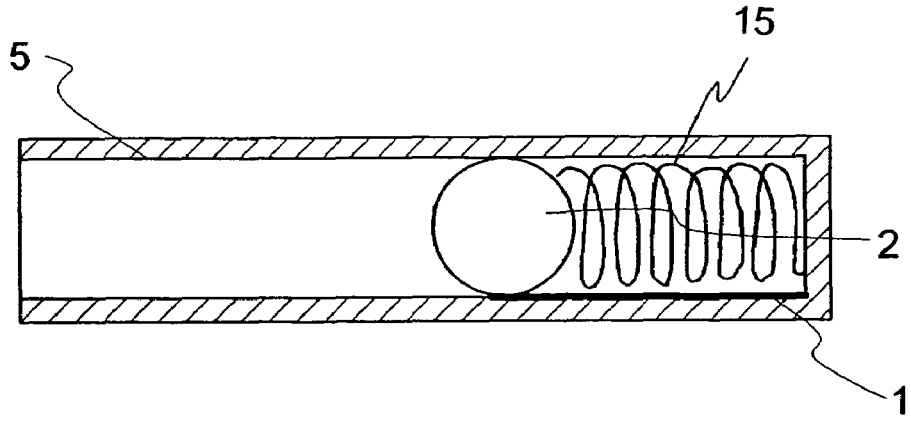
FIG. 1 illustrates an embodiment of a connector in an unconnected state without a memory card
Figure 2:
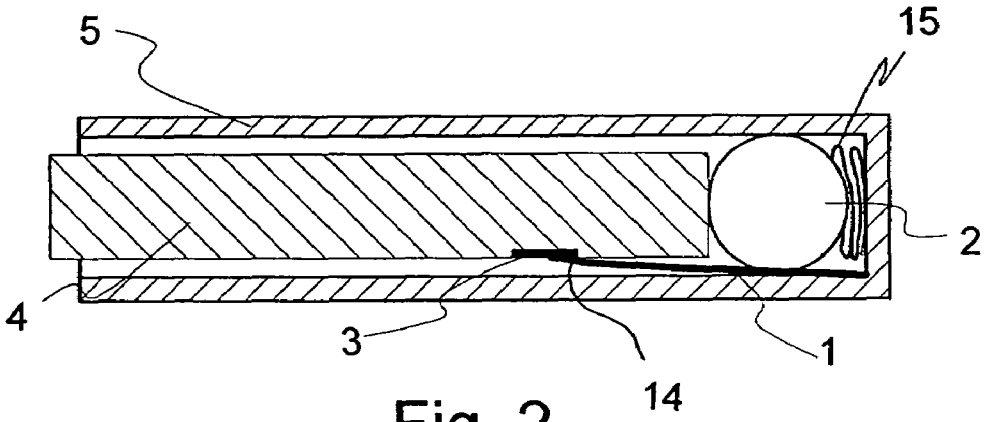
FIG. 2 illustrates the embodiment of FIG. 1 in a connected state with a memory card
Figure 3:
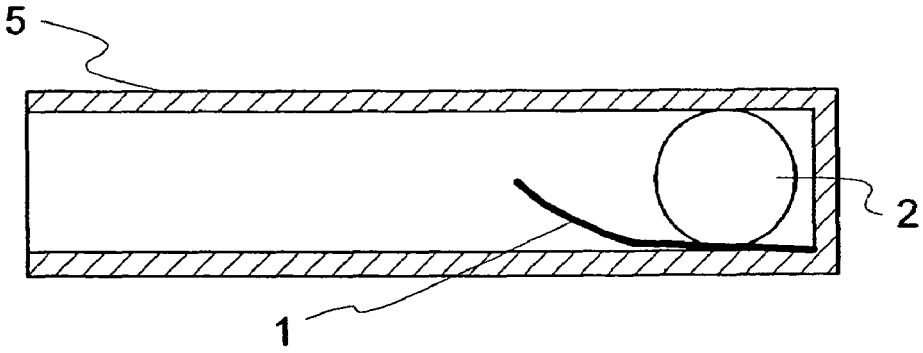
FIG. 3 illustrates the embodiment of FIG. 1 in an unconnected state without a memory card

FIGS. 1, 2 and 3 illustrate a connector device according to an embodiment. In this embodiment the device is a card reader. A similar connector can be used in many other applications as well, for example, audio, radio frequency (RF), power, and/or data connectors.

The connector comprises at least a contact element 1 and a pre-loading element 2. In the examples according the FIGS. 1 to 9, the contact element 1 is a contact spring. The contact spring 1 is adapted to contact a contact 3 of a memory card 4.

The contact spring 1 is curved so that its shape is similar to that of the tip of a ski. In the free state the tip of the contact spring 1 is pointing upwards so that it will force itself against the contacts 3 of the card 4 inserted in the reader. In addition, there is a pre-loading element 2, which keeps the contact spring 1 flat when there is no card 4 in the reader. The pre-loading element 2 is pushed off the contact spring 1 by the card 4 that is inserted into the reader.

In addition, in FIGS. 1, 2 and 3 are shown a housing 5 of the connector. In this embodiment the housing 5 forms some kind of a frame, where the contact springs 1 and the pre-loading element 2 are attached. The housing 5 can be formed in many different ways. The form depends, for example, on the device and the connected device (i.e. memory card). The housing 5 can also comprise other structures than those mentioned, for example, locking structures for keeping a memory card 4 in a reader. In addition, the housing 5 or a part of it can be a part of the device or it can be integrated in the device.

Figure 4:
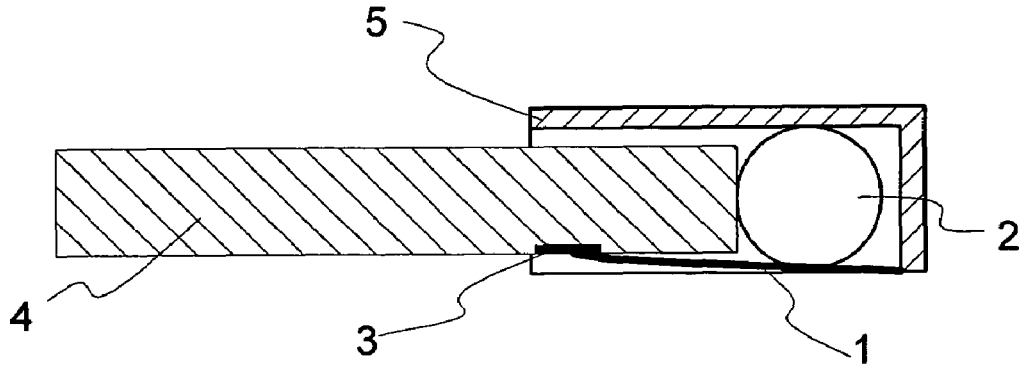
FIG. 4 illustrates another embodiment of a connector

FIG. 4 illustrates an embodiment, where the housing 5 does not comprise a typical bottom part, that is used to connecting the connector to the device. In this kind of a solution the surface of the device or another component creates at least one wall of the card slot of the connector. Thus, it is possible to produce very thin connectors and furthermore thin devices.

The contact spring 1 has at least an unconnected state and a connected state. In the unconnected state the contact spring 1 allows the card 4 to be insert in the connector. In the unconnected state the contact spring 1 does preferably not touch the contacts 3 of the card 4 and/or the card. In the connected state the contact spring 1 is allowed to touch the contacts 3 of the inserted card 4. In this embodiment a tip 14 of the contact spring 1 is adapted to form the contact with the contacts 3 of the inserted card 4 in the connected state. In this description and figures the movement and the shape of the contact spring 1 is only an example. The tip of the contact spring 1 can move more or less than in the examples when the contact element moves between the unconnected state and the connected state, depending on the solution. In addition, in the examples the connection point is produced between the tips of the contact springs 1 and contacts 3. It is possible to use a larger area of the contact spring 1 to produce the contact. For example, the contact spring 1 can be flat or almost flat in the connected state.

The pre-loading element 2 has at least a first position and a second position. When the pre-loading element 2 is in the first position, it forces the contact spring 1 into the unconnected state. Usually the first position is prevailing when there is no card 4 in the connector. When the pre-loading element 2 is in the second position, it allows the contact spring 1 to move into the connected state. Usually the second position is prevailing when there is card 4 in the connector.

The pre-loading element 2 can be formed in many ways. In one embodiment the pre-loading element 2 is provided with an actuator which moves the pre-loading element between the different positions. The actuator can be, for example, a spring 15 or a flexible member (see FIGS. 1 and 2). The pre-loading element 2 can also be an adaptable member, wherein the first position is a first shape and the second position is a second shape of the pre-loading element.

Figure 5:
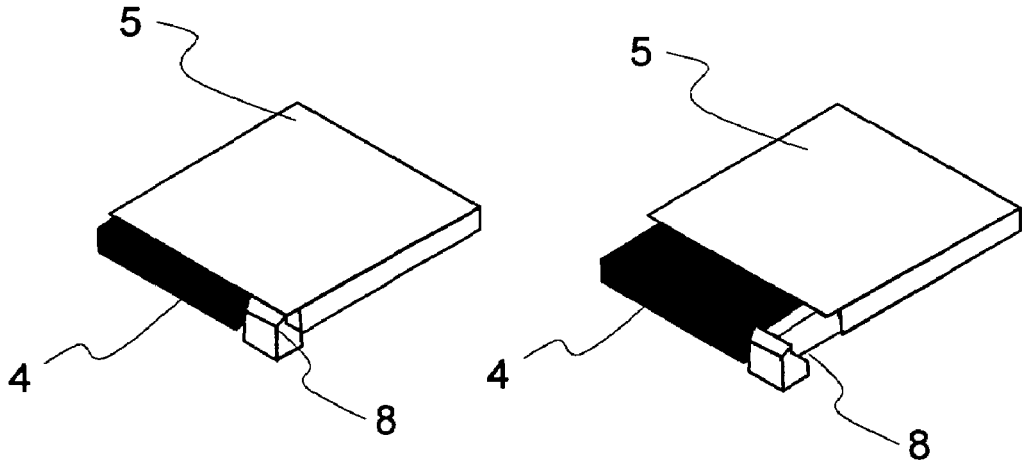
FIG. 5 illustrates an embodiment of a connector with an ejector structure

FIG. 5 illustrates an embodiment where the connector comprises an ejector 8. The ejector 8 can be used, for example, to remove the card 4 from the connector. In one solution the ejector 8 affects the pre-loading element 2. For example, when the ejector 8 is used to remove the card 4, at the same time it moves the pre-loading element 2 from the second position to the first position.

In many solutions the connector comprises many contact elements i.e. contact springs 1. In one embodiment the connector comprises several contact springs 1 and one pre-loading element 2 is adapted to affect these several contact springs. When the pre-loading element 2 is in the first position it forces the contact springs 1 into the unconnected state. When the pre-loading element 2 is in the second position it allows the contact springs 2 to move into the connected state.

Figure 6:
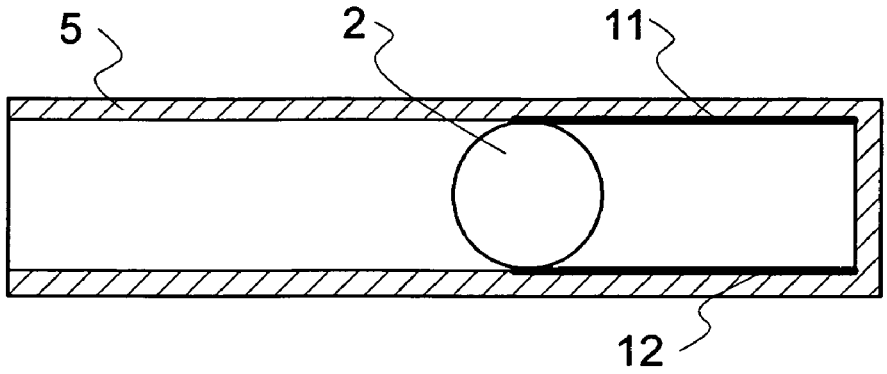
FIG. 6 illustrates another embodiment of a connector in an unconnected state
Figure 7:
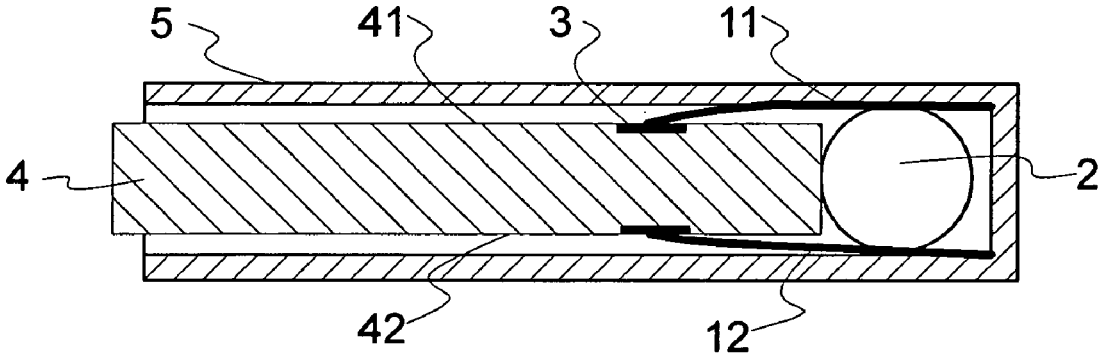
FIG. 7 illustrates the embodiment of FIG. 6 in a connected state with a memory card

FIGS. 6 and 7 illustrate another embodiment of the connector structure where the connector comprises a first group of contact springs 11 and a second group of contact springs 12. The first group of contact springs 11 is adapted to contact the first side of the memory card 41 and the second group of contact springs 12 is adapted to contact the second side of the memory card 42. In the shown embodiment one pre-loading element 2 is adapted to affect the first group of contact springs 11 and the second group of contact springs 12. When the pre-loading element 2 is in the first position it forces the groups of contact springs 11, 12 into the unconnected state, as can be seen in FIG. 6. When the pre-loading element 2 is in the second position, it allows the groups of contact springs 11, 12 to move into the connected state as can be seen in FIG. 7.

Figure 8:
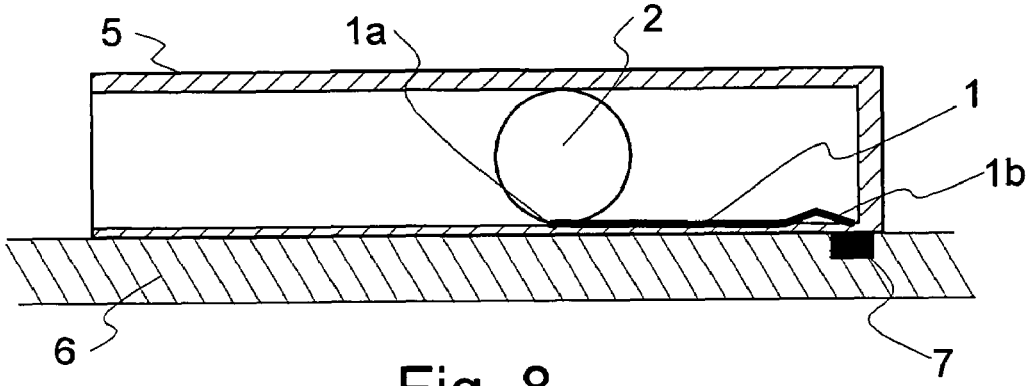
FIG. 8 illustrates another embodiment of a connector in an unconnected state
Figure 9:
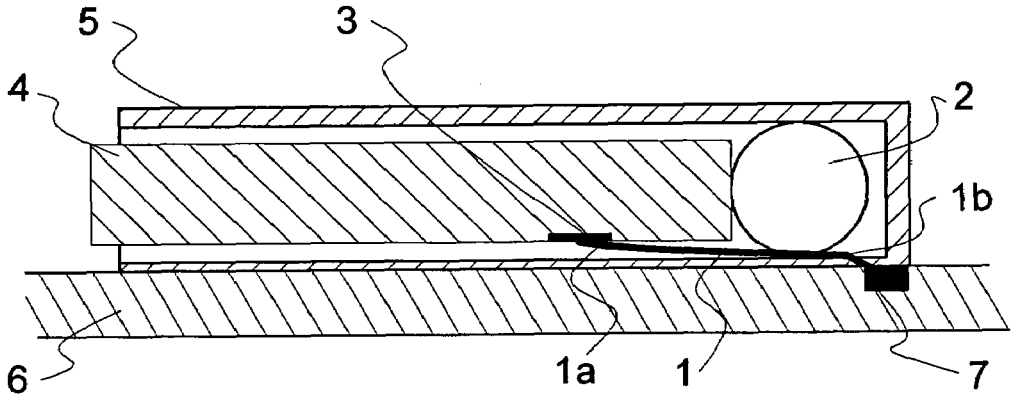
FIG. 9 illustrates the embodiment of FIG. 8 in a connected state with a memory card

In one solution the contact springs 1 are not electrically attached to the printed wiring board 6 all the time. When a card 4 is inserted to the card reader, the card presses a contact spring 1 so that the contact spring comes into contact with the printed wiring board 6, which has contact areas 7 for connection. In turn, when there is no card 4 in the card reader, the contacts with the printed wiring board 6 are disabled. One such solution is illustrated in FIGS. 8 and 9. FIG. 8 shows the situation when there is no card 4 in the card reader. FIG. 9, in turn, shows the situation when there is a card 4 in the card reader. As can be seen the contact spring 1 is adapted to contact also the contacts 3 of the card 4 and the contacts 7 of the printed wiring board 6. In this embodiment the contact spring 1 comprises a first contact area 1*a* and a second contact area 1*b*. The first contact area 1*a* is adapted to contact the contact 3 of the card 4. The second contact area 1*a* is adapted to contact the contact 7 of the printed wiring board 6. The pre-loading element 2 is adapted to force the contact spring 1 into the connected state.

Figure 10:
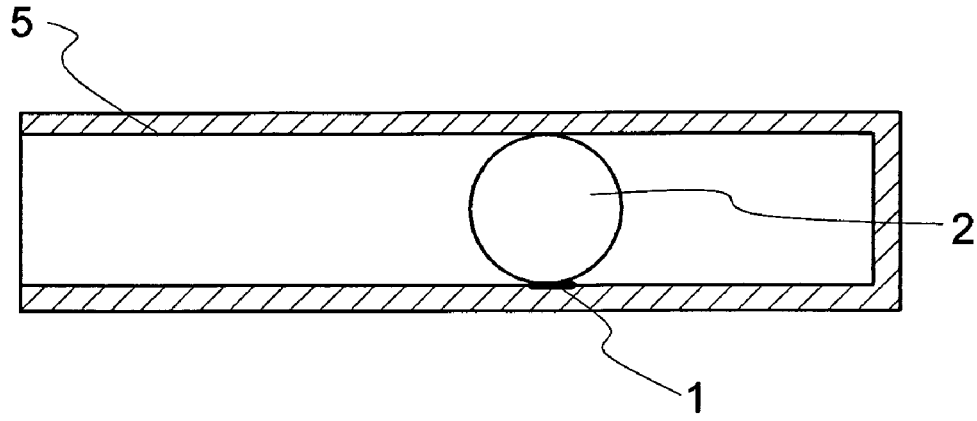
FIG. 10 illustrates another embodiment of a connector in an unconnected state
Figure 11:
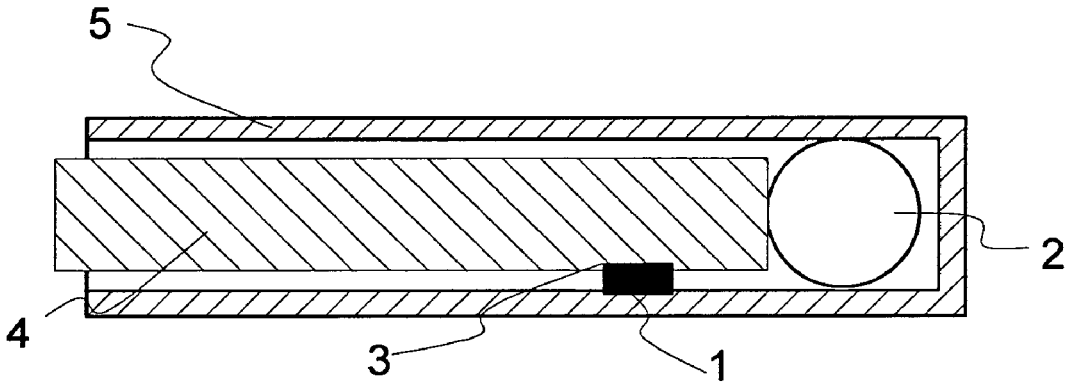
FIG. 11 illustrates the embodiment of FIG. 10 in a connected state with a memory card For the sake of clarity, the figures only show the details necessary for understanding the invention. The structures and details that are not necessary for understanding the invention but are obvious for anyone skilled in the art have been omitted from the figures in order to emphasize the characteristics of the invention.

FIGS. 10 and 11 illustrate another embodiment of the connector structure, where the connector comprises contact elements 1, which are elastic structures. An elastic structure returns to its original shape when a load is removed. In the shown embodiment the pre-loading element 2 is adapted to affect the contact elements 1. When the pre-loading element 2 is in the first position it forces the contact elements 1 into the unconnected state, as can be seen in FIG. 10. When the pre-loading element 2 is in the second position, it allows the contact elements 1 to expand into the connected state, as can be seen in FIG. 11.

In one embodiment the connector structure is used in an adapter. An adapter is needed when a card 4 is used in a reader, which is for a different type of card than the one used. For example, there are adapters which allow a microSD card to be used in devices intended for SD or miniSD cards. Usually the size of the card 4 and/or the layout of the connecting terminals are different in different kinds of cards. The connector structure according to the previous examples is very advantageous in adapters, especially adapters that adapt the card 4 to a card reader that has almost the same thickness as the card. It is possible to produce an adapter that comprises the foregoing connector structure. The card 4 can be inserted in the adapter and then the pre-loading element 2 moves from the first position to the second position. Therefore, it allows the contact element 1 to move into the connected state and the card 4 is connected to the device via the adapter (presuming that the adapter is in the device).

In addition, it is possible to adjust the foregoing ejector structure 8 in the adapter. In one embodiment the ejector structure 8 also ejects the card 4 out from the adapter and moves the pre-loading element 2 to the first position (unconnected state).

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A connector comprising:

a contact spring, which has at least an unconnected state and a connected state;

a pre-loading element, which has at least a first position and a second position;

wherein the pre-loading element is configured so that when in the first position it forces the contact spring into the unconnected states and when the pre-loading element is in the second position it allows the contact spring to transfer to the connected state so as to electrically contact a contact of a card insertable in said connector.

2. The connector according to claim 1, further comprising several contact springs, wherein one pre-loading element is configured to affect these several elements.

3. The connector according to claim 1, wherein a tip of the contact spring is configured to form a contact when in the connected state.

4. The connector according to claim 1, wherein the connector is a memory card connector and the contact spring is configured to contact a contact of the memory card.

5. The connector according to claim 4, further comprising several contact springs and wherein one pre-loading element is configured to affect these several contact springs.

6. The connector according to claim 4, further comprising a first group of contact springs and a second group of contact springs; wherein the first group of contact springs is configured to contact a first side of the memory card and the second group of contact springs is configured to contact a second side of the memory card.

7. The connector according to claim 6, wherein one pre-loading element is configured to affect the first group of contact springs and the second group of contact springs.

8. The connector according to claim 1, wherein the connector is at least one of the following: an audio connector, a radio frequency connector, a power connector, a data connector.

9. A device with a connector comprising:

a contact spring, which has at least an unconnected state and a connected state;

a pre-loading element, which has at least a first position and a second position;

wherein the pre-loading element is configured so that when in the first position it forces the contact spring into the unconnected states and when the pre-loading element is in the second position it allows the contact spring to transfer to the connected state so as to electrically contact a contact of a card insertable in said connector.

10. The device according to claim 9, further comprising several contact springs, wherein one pre-loading element is configured to affect these several contact springs.

11. The device according to claim 9, wherein a tip of the contact spring is configured to form a contact when in the connected state.

12. The device according to claim 9, wherein the connector is a memory card connector and the contact spring is configured to contact a contact of the memory card.

13. The device according to claim 12, further comprising several contact springs and wherein one pre-loading element is configured to affect these several contact springs.

14. The device according to claim 12, further comprising a first group of contact springs and a second group of contact springs; wherein the first group of contact springs is configured to contact a first side of the memory card and the second group of contact springs is configured to contact a second side of the memory card.

15. The device according to claim 14, wherein one pre-loading element is configured to affect the first group of contact springs and the second group of contact springs.

16. The device according to claim 9, wherein the device is at least one of the following: a mobile phone, a personal computer, a hand-held computer, a hand-held media device, a game machine.

17. The device according to claim 9, wherein the connector is at least one of the following: a card connector, a universal serial bus connector, a battery connector, a charger connector.

18. A connector comprising:

means for springingly contacting, which has at least an unconnected state and a connected state;

means for pre-loading, which has at least a first position and a second position;

wherein the means for pre-loading in the first position forces the means for springingly contacting into the unconnected state; and the means for pre-loading in the second position allows the means for springingly contacting to transfer to the connected state so as to electrically contact a contact of a card insertable in said connector.

* * * * *

UNITED STATES PATENT AND TRADEMARK OFFICE

CERTIFICATE OF CORRECTION

PATENT NO. : 7,690,935 B2
APPLICATION NO. : 12/002328
DATED : April 6, 2010
INVENTOR(S) : Laitinen It is certified that error appears in the above-identified patent and that said Letters Patent is hereby corrected as shown below:

At column 5, line 26, claim 1, line 9, please remove the word "states" and replace it with --state--.

At column 6, line 9, claim 9, line 9, please remove the word "states" and replace it with --state--.

Signed and Sealed this

Fifteenth Day of June, 2010

David J. Kappos

David J. Kappos
*Director of the United States Patent and Trademark Office*